US006409023B1

(12) United States Patent
Schabel

(10) Patent No.: US 6,409,023 B1
(45) Date of Patent: Jun. 25, 2002

(54) PROCESS AND DEVICE FOR FRACTIONING A SUSPENSION CONTAINING PAPER FIBERS

(75) Inventor: Samuel Schabel, Ravensburg (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/696,182

(22) Filed: Oct. 26, 2000

(30) Foreign Application Priority Data

Oct. 27, 1999 (DE) ..... 199 51 711

(51) Int. Cl.[7] ..... B07B 1/06

(52) U.S. Cl. ..... 209/283; 209/273; 209/306; 210/414

(58) Field of Search ..... 209/273, 274, 209/281, 283, 300, 305, 306; 210/413, 414, 415

(56) References Cited

U.S. PATENT DOCUMENTS 5,000,842 A * 3/1991 Ljokkoi ..... 209/306 X
5,307,939 A * 5/1994 Young et al. ..... 210/414 X
5,547,083 A * 8/1996 Alajaaski et al. ..... 209/273

FOREIGN PATENT DOCUMENTS

EP 0299258 1/1989
WO 94/25183 * 11/1994 ..... 209/306

* cited by examiner

*Primary Examiner*—Tuan N. Nguyen
(74) *Attorney, Agent, or Firm*—Greenblum & Bernstein, P.L.C.

(57) ABSTRACT

Process and device for fractioning a suspension containing paper fibers, in which the suspension is separated into at least two fractions by a wire with a scraper. The process includes moving the scraper in a substantially parallel relation to the wire so that the wire is kept clear, and a parallel current is created in the suspension with respect to an inlet side of the wire by a rough surface of the scraper, so that the suspension is dragged along the inlet side of the wire with the scraper with minimal slippage of the suspension. The device includes at least one wire having an inlet side with openings; and a scraper having a closed rough surface provided adjacent the at least one wire; wherein the scraper is movable substantially parallel to the inlet side of the at least one wire, whereby clogging of the openings of said wire is substantially prevented.

33 Claims, 3 Drawing Sheets

PROCESS AND DEVICE FOR FRACTIONING A SUSPENSION CONTAINING PAPER FIBERS

CROSS-REFERENCE TO RELATED APPLICATIONS

The present application claims priority under 35 U.S.C. § 119 of German Patent Application No. DE 199 51 711.8, filed on Oct. 27, 1999, the disclosure of which is expressly incorporated by reference herein in its entirety.

BACKGROUND OF THE INVENTION

1. Field of the Invention

The invention relates to a process according for fractioning a suspension containing paper fibers, in which the suspension is separated into at least two fractions by a wire with a moving scraper being used in relation to it for keeping the wire clear. The invention also relates to a device with a housing in which at least one wire is provided along which a scraper is moved at the inlet side in order to prevent the clogging of the wire openings of the wire.

2. Discussion of Background Information

It is known that aqueous paper fiber suspensions can be fractioned by processes of wet screening. There, different goals of the process can be pursued, first, the so-called sorting, i.e., removal of undesired particles from the paper fiber suspension or, secondly, the fiber fractioning, i.e., the separation of the paper fibers themselves into several fractions. Although sorting processes of many contaminants are possible with very good separation results, significant problems arise concerning the separation effect of soft, adhering contaminants, including stickies. In fiber fractioning, certain features of the paper fibers, e.g., length, thickness, or flexibility, are used as separation characteristics. Such a process allows the extraction of fibrous materials with special features out of fiber mixtures, e.g., used paper. However, native raw materials can also be fractioned according to their fiber characteristics. Generally, in fiber fractioning, a concentration of long fibers is achieved in the overflow of the wire and a concentration of short fibers is achieved in the flow-through of the wire. Up to now, the precision of the separation and/or the throughput in processes for fiber fractioning have frequently been insufficient.

Devices that are used, on the one hand, for sorting and, on the other hand, for fiber fractioning are structurally very similar. It is known that, in almost all of them, a wire scraper is passed very closely by the wire in order to prevent clogging of the wire and thus to enable a large flow through of the wire.

SUMMARY OF THE INVENTION

The invention is based on the purpose of creating a process that successfully achieves a higher separation effect in fractioning, even of problematic contaminants, such as, e.g., long fibers and stickies.

This aspect is attained by providing a process for fractioning a suspension containing paper fibers, in which the suspension is separated into at least two fractions by a wire with a moving scraper being used in relation to it for keeping the wire clear, wherein a parallel current is created at the inlet side of the wire with the help of a rough surface of the scraper at the inlet side in which the suspension is dragged along with the scraper almost without slippage.

Another aspect is attained by providing a device for performing the aforementioned process having a housing in which at least one wire is provided along which a scraper is moved at the inlet side in order to prevent the clogging of the wire openings of the wire wherein the scraper has a closed rough surface.

According to another aspect of the invention, a device is provided having a surface with a multitude of grooves that have a height of no more than about 3 mm. According to still a further aspect of the invention, the grooves have a maximum width of no more than about 3 mm. According to a further aspect of the invention, the grooves are positioned at a distance from one another of no more than about 3 mm.

Although the scrapers in the known processes serve the purpose of keeping the wire free of clogs by alternating pressure pulses and suction pulses or by creating turbulences, the process according to the invention causes a dragging current at the scraper that moves essentially parallel to the wire surface in the circumferential direction. The fibers located in the suspension are therefore oriented evenly and a separation according to their length and/or their flexibility is possible with an improved effectiveness. This is particularly true in sorting gaps directed laterally to the parallel current. The wire openings are kept free by micro turbulences and/or small-sized turbulences created by the surface structure of the wire in conjunction with the dragging current. The gentle maintenance of a clear wire according to the invention is more beneficial for the separation of delicate, easily braking contaminants, such as stickies. In order to create a dragging current, the scraper can be roughened, e.g., provided with a multitude of grooves. A felt applied onto the surface can also develop the dragging effect.

In many cases, the advantages of the invention can be best realized in scrapers whose surface facing the wire are mainly straight, i.e., that are not provided with a multitude of folds, wings, or bumps (protrusions in form of sphere sections). In other cases, it can be advantageous to find a compromise between the effectiveness of separation and the flow-through. Due to technical/physical reasons, it must often be accepted that, by creating a purely parallel current, the flow-through of the wire is reduced compared to a high turbulence process according to the prior art. Therefore, a choice must be made between the parallel current oriented as parallel as possible and a limited creation of turbulences. Weak turbulences can be created, e.g., by using a wire and/or a scraper containing profile grooves or moldings.

The versions of the process described so far were based on a fixed wire and a moving scraper. The kinematical reversion, i.e., a moving wire and a scraper that is fixed or moving in oppositional direction, can be imagined to perform the process according to the invention.

According to an aspect of the present invention, a process is provided for fractioning a suspension containing paper fibers, in which the suspension is separated into at least two fractions by a wire with a scraper. The process includes moving the scraper in a substantially parallel relation to the wire. the wire is kept clear, and a parallel current is created in the suspension with respect to an inlet side of the wire by a rough surface of the scraper, so that the suspension is dragged along the inlet side of the wire with the scraper with minimal slippage of the suspension.

According to another aspect of the present invention, the suspension is moved to at least about 90% of the speed of the scraper in a contact area reaching up to one millimeter away from the surface of the scraper. Additionally, other aspects of the present invention are provided including wherein the scraper is moved along the inlet side of the wire at a distance of no more than about 20 mm. In another aspect of the present invention, the scraper is moved at a speed of at least about 10 m/s in relation to the wire.

According to a further aspect of the present invention, the scraper is moved at a speed of at least about 20 m/s in relation to the wire. According to a further aspect of the present invention, the scraper creates substantially no pressure impulses or suction impulses towards the wire. In another aspect of the present invention, the scraper creates weak pressure impulses or suction impulses towards the wire.

According to a still further aspect of the present invention, the scraper has a scraping surface having a multitude of oblong indentations. In another aspect of the present invention, the multitude of oblong indentations includes grooves. Further aspects of the invention include a scraper that has a scraping surface including a felt which is easily wettable. According to other aspects of the present invention, the wire used for fractioning has oblong openings having a lengthwise positioning at an angle between about 70° and 110° in relation to the direction of motion of the scraper.

According to another aspect of the present invention, the wire used for fractioning creates locally limited turbulences with the aid of one of protrusions and indentations in cooperation with the parallel current.

According to a further aspect of the present invention, a device is provided for performing a process for fractioning a suspension containing paper fibers. The suspension is separated into at least two fractions by a wire with a scraper moved in a substantially parallel relation to the wire for keeping the wire clear. The process includes creating a parallel current in the suspension with respect to an inlet side of the wire with the assistance of a rough surface of the scraper in which the suspension is dragged along the inlet side of the wire with the scraper with minimal slippage of the suspension. The device includes a housing, at least one wire having an inlet side with openings, the wire provided within the housing, and a scraper having a closed rough surface, the scraper provided within the housing. Also the scraper is positioned near to and for movement substantially parallel to the inlet side of the wire, whereby clogging of the openings of the wire is substantially prevented.

According to another aspect of the present invention, the closed rough surface includes a plurality of grooves having a height of no more than about 3 mm. According to a further aspect of the present, the plurality of grooves has a maximum width of no more than about 3 mm. According to a still further aspect of the invention, the grooves are positioned at a distance from one another of no more than about 3 mm.

According to an aspect of the present invention, the closed rough surface of the scraper includes a layer of felt. According to another aspect of the present invention, the wire is provided with one of protrusions and indentations having a height or depth of no more than about 2 mm. Additionally, other aspects of the present invention include a wire that is a cylindrical wire and in which the scraper includes a cylindrical rotor is which is rotatable. In another aspect of the invention, the cylindrical wire and cylindrical rotor are concentric.

According to a further aspect of the present invention, a device for fractioning a suspension containing paper fibers, in which the suspension is separated into at least two fractions is provided. The device includes at least one wire having an inlet side with openings, and a scraper having a closed rough surface provided adjacent the at least one wire. The scraper is movable substantially parallel to the inlet side of the at least one wire, whereby clogging of the openings of the wire is substantially provided.

In another aspect of the present invention, the closed rough surface is provided with a plurality of grooves having a height of no more than about 3 mm. According to a further aspect of the present invention, the plurality of grooves have a maximum width of no more than about 3 mm. In another aspect of the present invention, the grooves are positioned at a distance from one another of no more than about 3 mm.

In another aspect of the invention, the closed rough surface of the scraper includes a layer of felt. According to a further aspect of the present invention, the wire is provided with one of protrusions and indentations having a height or depth of no more than about 2 mm. In another aspect of the present invention, the closed rough surface of the cylindrical scraper creates a parallel current in the suspension with respect to the inlet side of the wire and closed rough surface of the scraper in which the suspension is dragged along said inlet side of said wire with said scraper with minimal slippage of the suspension.

According to a still further aspect of the present invention, a housing is included with the device. Further aspects of the invention include the housing being cylindrically-shaped. According to another aspect of the present invention, the wire is cylindrically-shaped. According to a further aspect of the present invention, the wire is provided within the housing. Additionally, other aspects of the invention include a scraper that is cylindrically-shaped and provided concentrically within the at least one wire.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
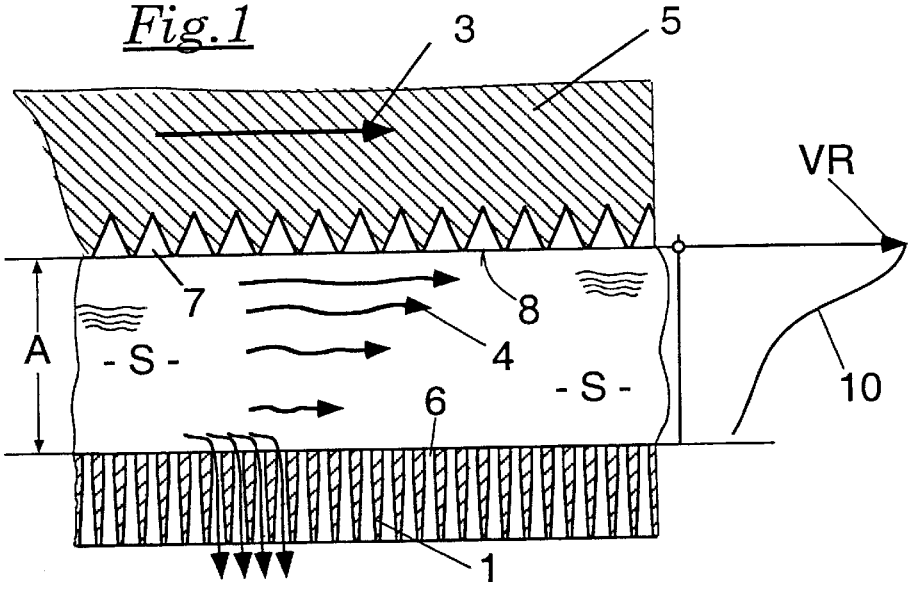
FIG. 1 Schematic illustration the process according to the invention at the wire inlet.

In FIG. 1, motions are shown that occur during the performance of the process in the area of the wire 1, the scraper 5, and the suspension S containing paper fibers that is being moved therebetween. It is generally known that the suspension S is fractioned by the wire 1 with one fraction draining through the wire openings 6 and another part being rejected and finally removed by a device used for this process into a place designed for this purpose. The scraper 5 is moved in the moving direction 3 marked by arrows at a distance A from the wire 1 and in relation to it. Since the surface 8 of the scraper 5 is rough, e.g., provided with a number of grooves 7 as depicted here, the suspension is dragged along almost without slippage so that a parallel current 4 develops. This parallel current 4 is not completely parallel to the surface of the wire facing the suspension. In the proximity of the inlet into the wire openings 6, e.g., the direction is deflected towards the wire 1. However, its direction is considerably different as compared to the uneven turbulent currents which usually are created in wire scrapers. In particular, the novel kind of current is stationary, i.e., constant over time, while conventional scrapers lead to a stationary current with pressure pulse intensity and turbulence intensity that vary over time. The speed profile depicted at the right side with the curve 10 demonstrates the dragging effect of the scraper designed according to the invention. In the proximity of the scraper, the suspension has about the same speed VR as the scraper 5 itself. The curve 10 then lowers in the direction of the wire, with clear parallel component remaining even at the wire 1. This way, a current develops in which long fibers, but also contaminants, are directed roughly parallel to the surface of the wire so that they have a strong tendency to be rejected at the sorting openings.

Figure 2:
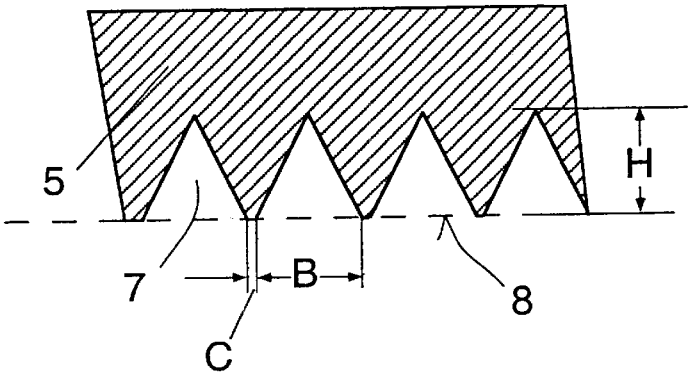
FIG. 2 Surface of a scraper according to the invention.

FIG. 2 depicts a detailed representation of a section through the surface of a scraper 5. In particular, the grooves 7 provided for creating the rough surface are measured. Their width B is advantageously smaller than about 3 mm at its largest point and its height H is a maximum of about 2 mm. Depending on the manner of use, other measurements can be practical. In order to achieve a good effect with such scrapers, as many grooves as possible must be present, i.e., have a short distance C from one another on the surface 8. They can be parallel straight lines; however, a pattern of diamonds or waves is also conceivable.

Figure 3:
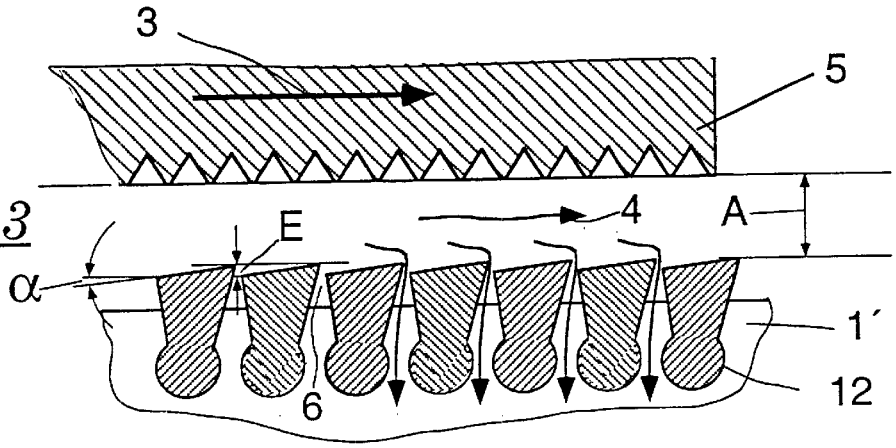
FIG. 3 Example of a varied wire.

The wire 1' used according to FIG. 3 has a profiled structure on the side of the inlet: the upper sides of the wire rods 12 are slightly tilted by the angle a in relation to the direction of the motion 3 so that spatially tightly limited microturbulences can form at the inlet to the wire openings. Due to the tilting, protrusions form over the wire gaps with a height E. Groove-like indentations of a corresponding depth can also be imbedded in the wire.

Figure 4:
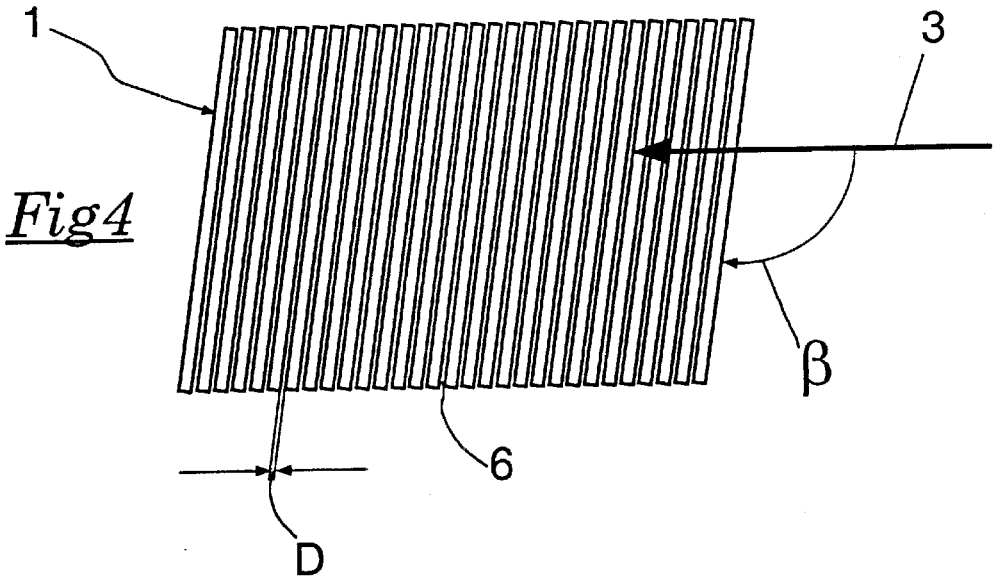
FIG. 4 Part of a suitable wire viewed from above.

The process can also be performed with a part of another wire, shown in FIG. 4. The predetermined direction of the motion 3 is also represented with which scraper (not shown) is moved in cooperation with this wire 1. The wire is provided with a multitude of wire openings 6 that are formed as narrow slits with a slit width D of approximately 0.1 to 0.4 mm, preferably about 0.15 to 0.25 mm. The longitudinal direction here has an angle β of about 100° in relation to the direction of motion 3. Generally, however, it is about 90°.

Figure 5:
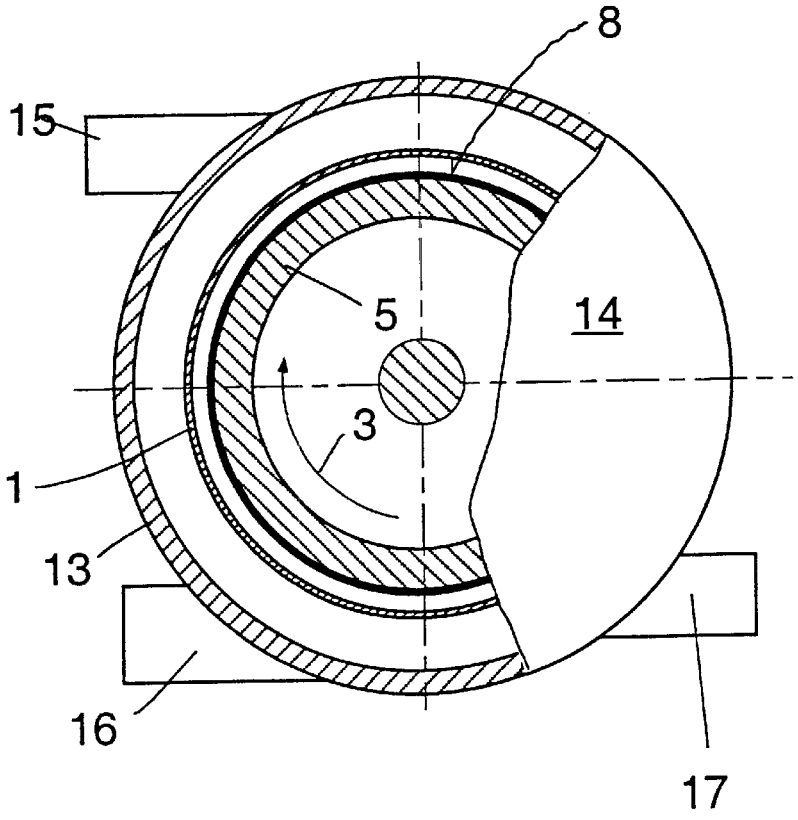
FIG. 5 Device for performing the process, viewed from above.

FIG. 5 shows schematically a fractioning device viewed from above. It contains a housing 13 with a partially depicted lid 14. The wire 1 is embodied as a cylindrical wire basket, the scraper 5 as a cylindrical rotor. The rough surface 8 is implied as a wide circular line. The suspension flows through the inlet 15 between the wire 1 and the rotor. The wire throughput is removed through the fine fraction outlet 16 and the wire overflow through the coarse fraction outlet 17. In special cases, more than these two fractions can be formed, e.g., several fine fractions using differently designed wire openings. The wire and the rotor are positioned concentrically to one another; however, other embodiments are possible as well.

Figure 6:
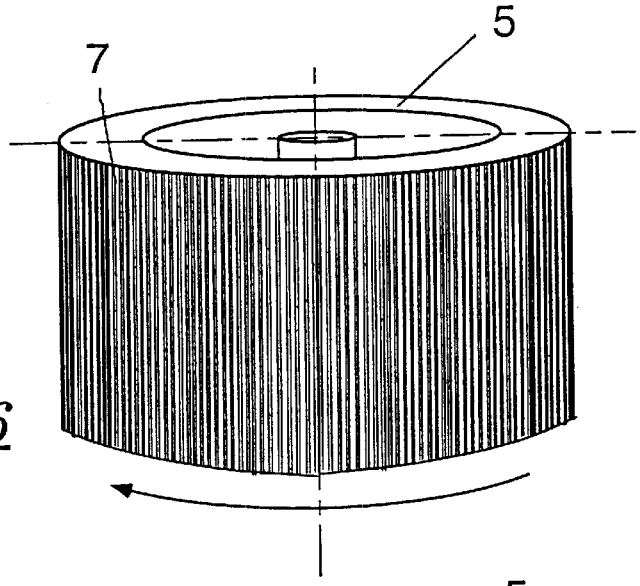
FIGS. 6–7 Different rotors usable as scrapers.

FIG. 6 shows in a geometrical representation a scraper 5 formed as a circular cylindrical rotor with grooves 7 essentially parallel to the axis. Such a form set concentrically inside of a circular cylindrical wire has a very conserving effect, i.e., it does not create any significant pressure impulses and/or suction impulses.

Figure 7:
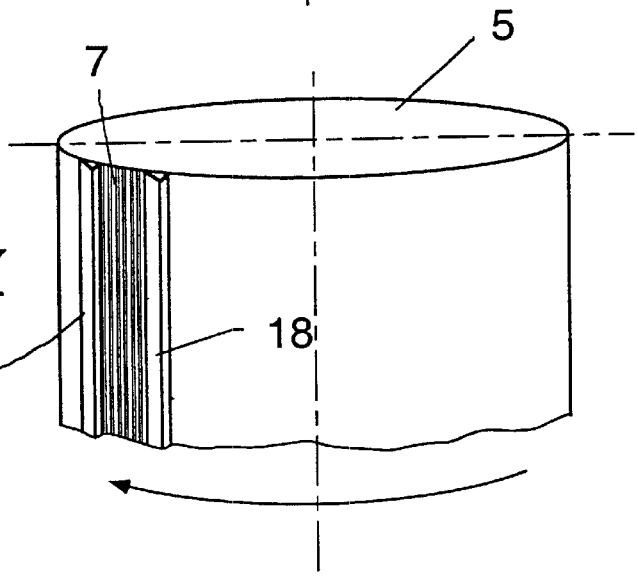

In the event that at least weak pressure and/or suction impulses are to be created, e.g., in order to increase the throughput at the wire, the scraper can be provided with profile moldings 18 according to FIG. 7. They can also enhance the creation of the parallel current, e.g., with the help of a steep frontal edge.

Figure 8:
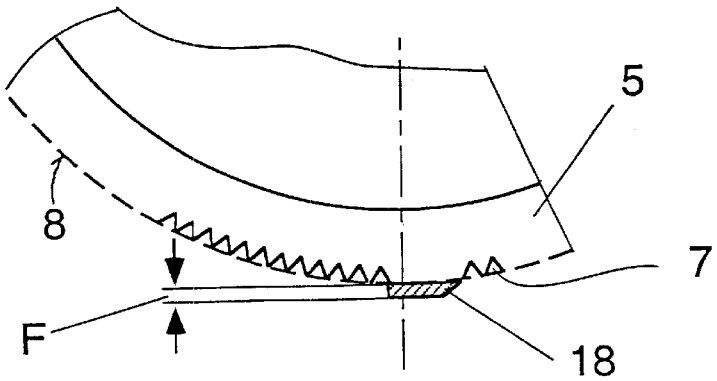
FIG. 8 Detail of a special scraper.

In order not to interfere with the desired effect of the invention, the moldings 18 should have only a low height F (FIG. 8). Their number can also be very low, e.g., two through five spread over the circumference.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for fractioning a suspension containing paper fibers, in which the suspension is separated into at least two fractions, said device comprising:

at least one wire having an inlet side with openings; and a scraper having a closed rough surface provided adjacent said at least one wire;

wherein said scraper is movable substantially parallel to said inlet side of said at least one wire and said closed rough surface is arranged to drag the suspension over said wire, whereby clogging of said openings of said wire is substantially prevented.

2. The device according to claim 1, wherein said closed rough surface is provided with a plurality of grooves having a height of no more than about 3 mm.

3. The device according to claim 2, wherein said plurality of grooves have a maximum width of no more than about 3 mm.

4. The device according to claim 2, wherein said grooves are positioned at a distance from one another of no more than about 3 mm.

5. The device according to claim 1, wherein said closed rough surface of said scraper comprises a layer of felt.

6. The device according to claim 1, wherein said wire is provided with one of protrusions and indentations having a height or depth of no more than about 2 mm.

7. The device according to claim 1, wherein said closed rough surface of said cylindrical scraper creates a parallel current in the suspension with respect to said inlet side of said wire and closed rough surface of said scraper in which the suspension is dragged along said inlet side of said wire with said scraper with minimal slippage of the suspension.

8. The device according to claim 1, further comprising a housing.

9. The device according to claim 8, wherein said housing is cylindrically-shaped.

10. The device according to claim 9, wherein said wire is cylindrically-shaped.

11. The device according to claim 10, wherein said wire is provided within said housing.

12. The device according to claim 11, wherein said scraper is cylindrically-shaped.

13. The device according to claim 12, wherein said scraper is provided concentrically within said at least one wire.

14. A process for fractioning a suspension containing paper fibers, in which the suspension is separated into at least two fractions by a wire with a scraper, the process comprising:

moving the scraper in a substantially parallel relation to the wire;

wherein the wire is kept clear, and wherein a parallel current, relative to an inlet side of the wire, is created in the suspension by a rough surface of the scraper that drags the suspension along the inlet side of the wire with minimal slippage of the suspension.

15. The process according to claim 14, wherein the suspension is moved to at least about 90% of the speed of the scraper in a contact area reaching up to one millimeter away from the surface of the scraper.

16. The process according to claim 14, wherein the scraper is moved along the inlet side of the wire at a distance of no more than about 20 mm.

17. The process according to claim 14, wherein the scraper is moved at a speed of at least about 10 m/s in relation to the wire.

18. The process according to claim 17, wherein the scraper is moved at a speed of at least about 20 m/s in relation to the wire.

19. The process according to claim 14, wherein the scraper creates substantially no pressure impulses or suction impulses towards the wire.

20. The process according to claim 14, wherein the scraper creates weak pressure impulses or suction impulses towards the wire.

21. The process according to claim 14, wherein the scraper has a scraping surface comprising a multitude of oblong indentations.

22. The process according to claim 21, wherein the multitude of oblong indentations comprise grooves.

23. The process according to claim 14, wherein a scraper has a scraping surface comprising a felt which is easily wettable.

24. The process according to claim 14, wherein the wire used for fractioning has oblong openings having a lengthwise positioning at an angle between about 70° and 110° in relation to the direction of motion of the scraper.

25. The process according to claim 14, wherein the wire used for fractioning creates locally limited turbulences with the aid of one of protrusions and indentations in cooperation with the parallel current.

26. A device in which a process for fractioning a suspension containing paper fibers is performed, in the process the suspension is separated into at least two fractions, the device comprising:

a housing;

at least one wire having an inlet side with openings, said wire provided within said housing; and a scraper having a closed rough surface, said scraper provided within said housing;

wherein said closed rough surface of said scraper is positioned near to and for movement substantially parallel to said inlet side of said at least one wire to create a current in the suspension substantially parallel to an inlet side of said at least one wire, whereby the suspension is dragged along said inlet side of said at least one wire with minimal slippage by said closed rough surface, and whereby clogging of said openings of said at least one wire is substantially prevented.

27. The device according to claim 26, wherein said closed rough surface comprises a plurality of grooves having a height of no more than about 3 mm.

28. The device according to claim 27, wherein said plurality of grooves have a maximum width of no more than about 3 mm.

29. The device according to claim 27, wherein said grooves are positioned at a distance from one another of no more than about 3 mm.

30. The device according to claim 26, wherein said closed rough surface of said scraper comprises a layer of felt.

31. The device according to claim 26, wherein said wire is provided with one of protrusions and indentations having a height or depth of no more than about 2 mm.

32. The device according to claim 26, wherein said wire comprises a cylindrical wire and in which said scraper comprises a cylindrical rotor is which is rotatable.

33. The device according to claim 32, wherein said cylindrical wire and cylindrical rotor are concentric.

* * * * *